US009748723B2

(12) United States Patent
Sussman

(10) Patent No.: US 9,748,723 B2
(45) Date of Patent: Aug. 29, 2017

(54) SOLDER-LESS BOARD-TO-WIRE CONNECTOR

(71) Applicant: Peter Sussman, St. Louis Park, MN (US)

(72) Inventor: Peter Sussman, St. Louis Park, MN (US)

( * ) Notice: Subject to any disclaimer, the term of this patent is extended or adjusted under 35 U.S.C. 154(b) by 64 days.

(21) Appl. No.: 14/831,343

(22) Filed: Aug. 20, 2015

(65) Prior Publication Data

US 2016/0172786 A1 Jun. 16, 2016

Related U.S. Application Data

(60) Provisional application No. 62/091,158, filed on Dec. 12, 2014.

(51) Int. Cl.

| | |
|---|---|
| ***H01R 12/58*** | (2011.01) |
| ***H01R 12/62*** | (2011.01) |
| ***H01R 12/78*** | (2011.01) |
| ***H01R 43/20*** | (2006.01) |
| ***H01R 4/18*** | (2006.01) |
| ***H01R 12/53*** | (2011.01) |
| ***H01R 43/048*** | (2006.01) |
| *H01R 13/58* | (2006.01) |

(52) U.S. Cl.

CPC ..... *H01R 43/205* (2013.01); *H01R 4/182* (2013.01); *H01R 12/53* (2013.01); *H01R 43/048* (2013.01); *H01R 13/58* (2013.01)

(58) Field of Classification Search

CPC ..... H01R 12/58; H01R 12/62; H01R 9/091; H01R 12/592; H01R 12/613; H01R 12/777; H01R 12/778; H01R 12/78; H01R 12/79; H05K 1/118; H05K 2201/0367; H05K 2201/0394; H05K 2201/1059; H05K 2201/10666

USPC ..... 439/741, 84; 174/262, 267

See application file for complete search history.

(56) References Cited

U.S. PATENT DOCUMENTS

| | | | |
|---|---|---|---|
| 2,543,048 | A | 2/1951 | Nachod |
| 2,918,649 | A | 12/1959 | Staley |
| 2,990,533 | A | 6/1961 | Hughes et al. |

(Continued)

FOREIGN PATENT DOCUMENTS

JP H01260885 A 10/1989

OTHER PUBLICATIONS

International Search Report and Written Opinion dated Mar. 18, 2016 for International Application No. PCT/US2015/063979 filed Dec. 4, 2015, 10 pages.

*Primary Examiner* — James Harvey
*Assistant Examiner* — Matthew T Dzierzynski
(74) *Attorney, Agent, or Firm* — Leanne Taveggia Farrell; Westman, Champlin & Koehler, P.A.

(57) ABSTRACT

A board-to-wire connector includes a substrate, a pair of wires and a pair of electrically conducting rivets. The substrate has a first surface, an opposing second surface and at least two electrically conducting traces having respective conductive pads. The pair of wires are each electrically preassembled to one of the electrically conducting traces through the respective conductive pads with solder joints. The pair of electrically conducting rivets each extend through the substrate from the first surface to the second surface and through one of the electrically conducting traces and have prongs that protrude from the second surface of the substrate.

20 Claims, 3 Drawing Sheets

(56) References Cited

U.S. PATENT DOCUMENTS 2,997,680 A 8/1961 Arthur
3,445,929 A 5/1969 Wolf
3,536,821 A 10/1970 Doering, Jr.
3,557,300 A 1/1971 Werner
3,704,173 A 11/1972 McClelland et al.
3,980,367 A 9/1976 Laserson et al.
4,110,904 A 9/1978 Johnson
4,173,035 A * 10/1979 Hoyt ..... F21V 21/08 361/749
4,812,130 A 3/1989 Altenschulte et al.
4,894,029 A 1/1990 Pope
5,065,283 A 11/1991 Adachi et al.
5,091,958 A 2/1992 Sakamoto et al.
5,404,282 A 4/1995 Klinke et al.
6,456,506 B1 * 9/2002 Lin ..... H05K 9/0039 174/138 G
6,490,168 B1 * 12/2002 Rochowicz ..... H05K 3/368 174/138 G
6,726,502 B1 * 4/2004 Hayes ..... F21V 21/002 439/422
7,046,020 B2 * 5/2006 LaMeres ..... G01R 1/07314 324/754.07
7,306,353 B2 12/2007 Popovich et al.
7,377,669 B2 * 5/2008 Farmer ..... F21S 4/10 362/219
7,448,923 B2 * 11/2008 Uka ..... H01R 4/024 174/88 R
7,638,814 B2 12/2009 Wall, Jr. et al.
7,703,941 B2 * 4/2010 Lee ..... G09F 9/33 362/217.17
7,771,204 B2 * 8/2010 Stoyan ..... F21V 23/06 439/56
7,785,113 B2 * 8/2010 Mizoguchi ..... H01R 12/58 439/67
7,918,681 B2 4/2011 Ju
8,075,322 B2 12/2011 Schwettmann et al.
8,500,456 B1 * 8/2013 Holec ..... H01R 4/02 439/65
8,568,001 B2 10/2013 Daily et al.
9,049,787 B2 * 6/2015 Bugg ..... H01R 9/032
9,052,074 B2 * 6/2015 Katzler ..... F21S 4/003
9,198,558 B2 * 12/2015 Nagaoka ..... A61B 1/00057
9,478,879 B2 * 10/2016 Iwano ..... H05K 1/114
2004/0119603 A1 6/2004 Bohlander et al.
2005/0179454 A1 8/2005 LaMeres et al.
2005/0242160 A1 * 11/2005 Nippa ..... B23K 1/0008 228/180.21
2007/0047243 A1 3/2007 Hacker et al.
2008/0254653 A1 * 10/2008 Uka ..... H01R 4/024 439/67
2009/0267533 A1 10/2009 Lee
2012/0120644 A1 * 5/2012 Rieger ..... F21S 4/00 362/219
2012/0195024 A1 * 8/2012 Kawaguchi ..... H05K 3/363 362/97.2
2014/0066715 A1 3/2014 Nagaoka

* cited by examiner

SOLDER-LESS BOARD-TO-WIRE CONNECTOR

CROSS REFERENCE TO RELATED APPLICATION

The present application is based on and claims the benefit of U.S. provisional patent application Ser. No. 62/091,158, filed Dec. 12, 2014, the content of which is hereby incorporated by reference in its entirety.

BACKGROUND

Light emitting diode printed circuit boards (LED PCBs) are designed to hold discrete LED components in an array of one or more LEDs. The LED PCBs can be made out of a rigid circuit board material or flexible circuit board material and the size and shape of the LED PCBs vary widely. In order for the LED PCBs to operate they are electrically attached to a power source.

The discussion above is merely provided for general background information and is not intended to be used as an aid in determining the scope of the claimed subject matter.

SUMMARY

A board-to-wire connector includes a substrate having a first surface, an opposing second surface and at least two electrically conducting traces having respective conductive pads. A pair of wires are each electrically connected to one of the electrically conducting traces through the respective conductive pads with solder joints. A pair of electrically conducting rivets each extend through the substrate from the first surface to the second surface and through one of the electrically conducting traces and have prongs that protrude from the second surface of the substrate.

An electrical assembly includes at least one circuit board including a first surface and an opposing second surface and has an array of one or more discrete components. The at least one circuit board includes at least two conducting traces and a pair of vias punched through the at least one circuit board that each extend through one of the two conducting traces. A board-to-wire connector includes a connector board, a pair of power wires and a pair of electrically conductive rivets. The connector board has a thickness that is less than a thickness of the one or more discrete components on the at least one circuit board and at least two electrically conducting traces having respective conductive pads. The pair of power wires are each electrically connected at distal ends to one of the electrically conducting traces of the connector board through the respective conductive pad with solder joints. The pair of electrically conductive rivets each extend through the connector board and through one of the electrically conducting traces and have prongs that protrude from a surface of the connector board. The prongs on the pair of rivets are located within the pair of vias on the at least one circuit board and are crimped to form a permanent electrical and mechanical connection with the at least one circuit board.

A method includes connecting at least one circuit board to a power source. The prongs on the pair of electrically conductive rivets are inserted through the vias extending through the at least one circuit board. The board-to-wire connector includes a thickness that is less than thicknesses of discrete components on the at least one circuit board. The prongs are crimped to electrically connect electrical conducting traces on the at least one circuit board to a pair of wires that electrically connect to a power source through electrical conducting traces on the board-to-wire connector.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Figure 1:
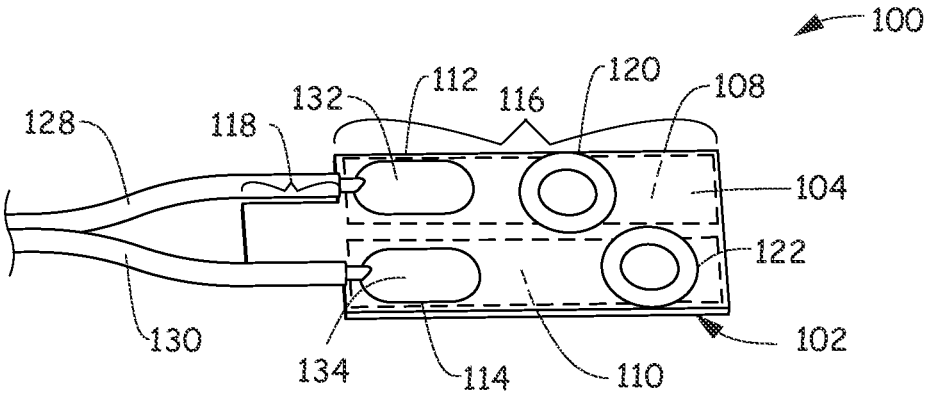
FIG. 1 illustrates a top perspective view of a board-to-wire connector in accordance with one embodiment.

Embodiments described below include a board-to-wire connector for electrically connecting a light emitting diode printed circuit board (LED PCB) to a power source in the field without using solder. The board-to-wire connector includes a pair of electrically conductive rivets extending through a substrate or board and through a pair of electrically conducting traces laminated to the substrate or board. The rivets include prongs that protrude from a surface of the substrate or board. Wires, which were previously electrically connected to the substrate or board at conductive pads using solder, connect the board-to-wire connector to a power source. In the field, a user takes the pre-assembled board-to-wire connector and inserts the prongs into vias in a LED PCB. A mechanical tool is used to crimp the prongs to the vias so as to form a permanent, solder-less connection.

LED edge lighting is a technology used to illuminate graphic displays, such as graphic displays in retail stores or other locations of high traffic. The edge-lit graphic displays include side channels housing a strip of one or more LED PCBs, a light guide panel, such as a panel made of acrylic, and in some cases, but not all cases a graphic. The LEDs on the LED PCBs must be placed adjacent to the ends of the light guide panel so that light from the LEDs travels through the ends of the acrylic and evenly illuminates the graphic that is located adjacent to a front surface of the acrylic.

Connecting the one or more LED PCBs to a power source is commonly accomplished in two ways. In a first configuration, wires are soldered directly to the LED PCBs. In another configuration, an integrated circuit (IC) socket or electrical connector that includes a housing with pins, such as a ZIF connector, can be connected to the one or more LED PCBs. Unfortunately, these types of electrical connections add a thickness to the LED PCB that is greater than the combined thickness of the LED PCB board material and the discrete LED components that are coupled to the LED PCB causing the connectors to interfere with the light guide of the edge lit graphic display. In these connection areas, the light guide panel would need to be notched out to accommodate for the increased thickness that is beyond the height of the discrete LED components. Making notches in the light guide panel is not only labor intensive, but also can lead to detrimental light shadowing, which is when light keeps bouncing back and forth in the acrylic and does not evenly illuminate. In addition, while it is possible for these types of electrical connectors to be added to LED PCBs before the LED PCBs are assembled to the graphic display, in some instances, being able to assemble an edge-lit graphic display in the field in real-time using reels of LED PCB strip that can be cut to a specific length is beneficial. In the applications described in this paragraph, soldering wires or soldering electrical connections in the field is difficult if not limiting due to labor intensity and skill.

Figure 2:
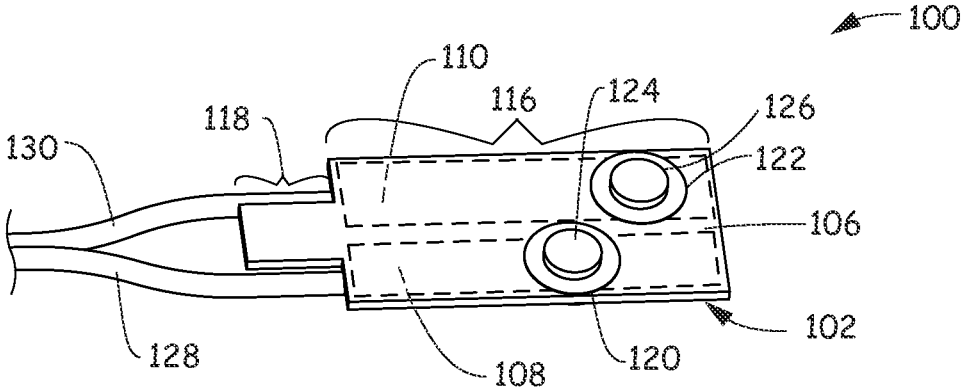
FIG. 2 illustrates a bottom perspective view of the board-to-wire connector in FIG. 1.
Figure 3:
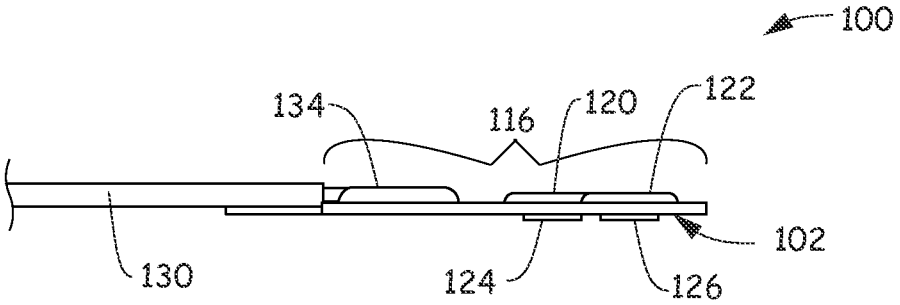
FIG. 3 illustrates a side view of the board-to-wire connector in FIG. 1.

FIG. 1 is a top perspective view of a board-to-wire connector 100, FIG. 2 is a bottom perspective view of a board-to-wire connector 100 and FIG. 3 is a side view of board-to wire connector 100. Board-to-wire connector 100 includes a substrate or board 102 having a first surface 104 and an opposing second surface 106. Laminated within substrate or board 102 is a pair of electrically conducting traces 108 and 110 (one with negative polarity and one with positive polarity) having respective conductive pads 112 and 114. Substrate or board 102 includes a distal or component section 116 and a proximal or stress relief section 118. Distal section 116 houses components of board 102 including electrically conducting traces 108 and 110, respective conductive pads 112 and 114 and a pair of rivets 120 and 122 that will be further discussed below. Proximal section 118 extends from distal section 116 and is free of components including conductive traces, conductive pads and rivets. Proximal section 118 provides stress relief to wires 128 and 130 and will be described in more detail below.

Board-to-wire connector 100 further includes a pair of electrically conducting rivets 120 and 122 that extend through substrate or board 102 from first surface 104 to second surface 106. In particular, first rivet 120 extends through board 102 and first electrically conductive trace 108 and second rivet 122 extends through board 102 and second electrically conductive trace 110. In this way, first rivet 120 is electrically connected to first electrically conductive trace 108 and second rivet 122 is electrically connected to second electrically conductive trace 110. Each of rivets 120 and 122 include a prong 124 and 126, respectively, that protrude from second surface 106 of substrate or board 102.

Board-to-wire connector 100 further includes a pair of wires 128 and 130 that are electrically connected to electrical conducing traces 108 and 110 through electrical conductive pads 112 and 114. This electrical connection is preassembled to board-to-wire connector 100 with solder joints 132 and 134, respectively. As illustrated in FIGS. 1 and 2, proximal or stress relief section 118 of substrate or board 102 extends from distal or component section 116 and is positioned between wires 128 and 130. Proximal section 118 is free of conductive traces and reduces the strain on solder joints 132 and 34 to prevent delamination of board 102.

Figure 4:
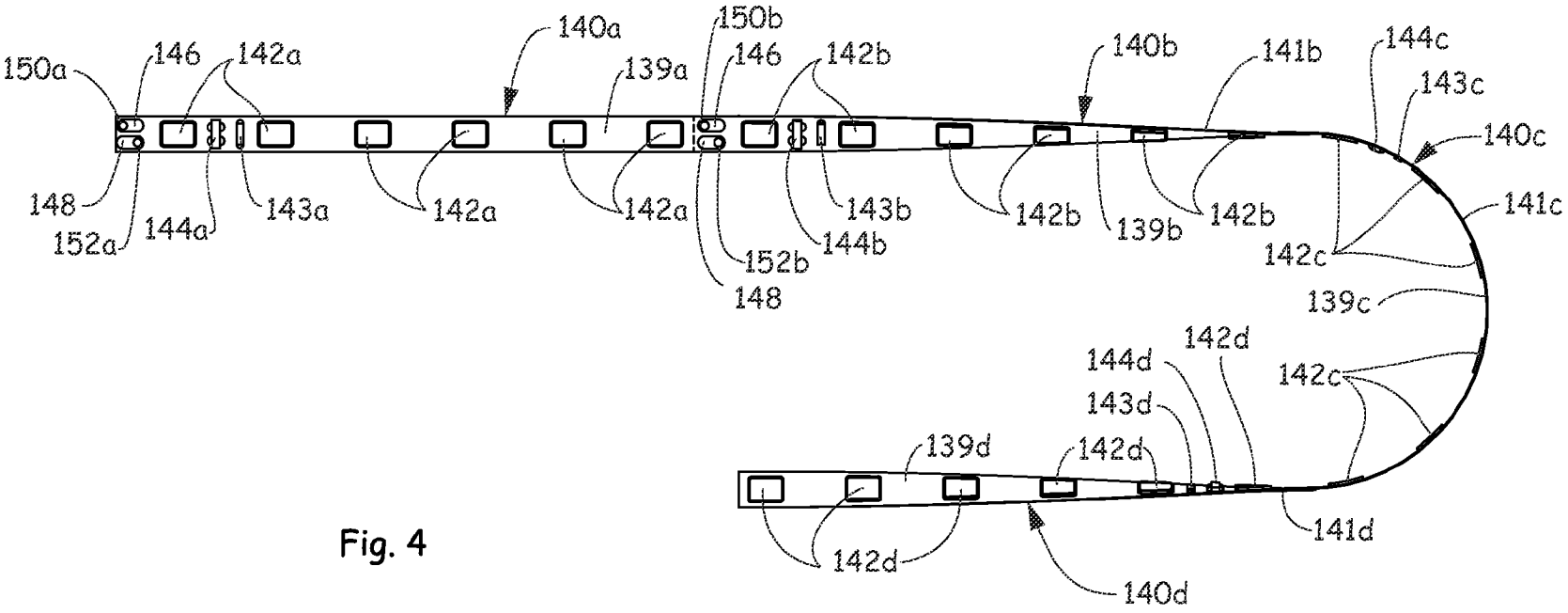
FIG. 4 illustrates a perspective view of a plurality of LED circuit boards formed together into a strip in accordance with one embodiment.

FIG. 4 illustrates a perspective view of multiple circuit boards 140*a*, 140*b*, 140*c* and 140*d*, which in the embodiment illustrated in FIG. 4 are each LED PCBs. LED PCBs 140*a*, 140*b*, 140*c* and 140*d* can be made from a rigid circuit board substrate material, such as fiberglass, or flexible circuit board substrate material, such as polyimide, as is shown in FIG. 4. Although four LED PCBs are illustrated, a strip will have many more and be collated on a wheel. he size and shape of the LED PCBs can vary widely. In the example illustrated in FIG. 4, LED PCBs 140*a*, 140*b*, 140*c* and 140*d* are connected and manufactured in strip form and each include a first surface 139*a*, 139*b*, 139*c* and 139*d* and a second surface (not shown for LED PCB 140*a*) 141*b*, 141*c* and 141*d*. Further, each LED PCB 140*a-d* has discrete LED components including, for example, at least one LED 142*a*, 142*b*, 142*c* and 142*d* in an array of LEDs, a resistor 143*a*, 143*b*, 143*c* and 143*d* and an Integrated Circuit (IC) 144*a*, 144*b*, 144*c* and 144*d* for controlling, regulating, driving or any other function necessary for operating the at least one LED 142*a-d* or the array of LEDs. It should be realized that in some embodiments not all of the discrete LED components listed above may be included in LED PCB 140*a-d* and in other embodiments more discrete components than those listed above may be part of LED PCB 140*a-d*. Laminated within LED PCBs 140*a-d* includes a pair of traces 146 and 148 (one with negative polarity and one with positive polarity) that electrically connect LEDs 142*a-d*, resistors 143*a-d* and ICs 144*a-d*. As illustrated in FIG. 4, traces 146 and 148 are exposed to the environment at the vias, which will be discussed in more detail below.

In LED PCBs 140*a-d*, conductive traces 146 and 148 extend along the upper side of LED PCB 140 in order to connect the discrete LED components including LED 142, resistor 143 and IC 144. Another pair of conductive corresponding traces (not illustrated in FIG. 4) extend along the lower side of LED PCB 140 and are called the BUS layer. As illustrated in FIG. 4, LED PCBs 140*a-d* can come in a strip form where multiple circuits or LED PCBs 140*a-d* are connected or formed together in series during manufacture to make one long strip. In this form, the strip can be cut at any end or beginning of another circuit or LED PCB 140 depending on the length of LEDs that is required. The end or beginning of a circuit is denoted by a dashed line in FIG. 4

Punched through or drilled through LED PCBs 140*a-d* and through conductive traces 146 and 148 are a pair of vias 150*a-d* and 152*a-d* (150*c-d* and 152*c-d* not shown in FIG. 4) for each LED PCB circuit 140*a-d*. In this embodiment, vias 150*a-d* and 152*a-d* are holes that extend from first surface 139*a-d* to second surface 141*a-d* of LED PCBs 140*a-d*. Vias 150*a-d* electrically connect upper trace 146 with the corresponding lower trace (not shown). Vias 152*a-d* electrically connect upper trace 148 with the corresponding lower trace (not shown). During manufacture, each drilled hole is electrostatic plated, the outer diameter of the hole is deposited with a copper layer and charged so that the traces of LED PCBs 140*a-d* are electrically coupled.

Figure 5:
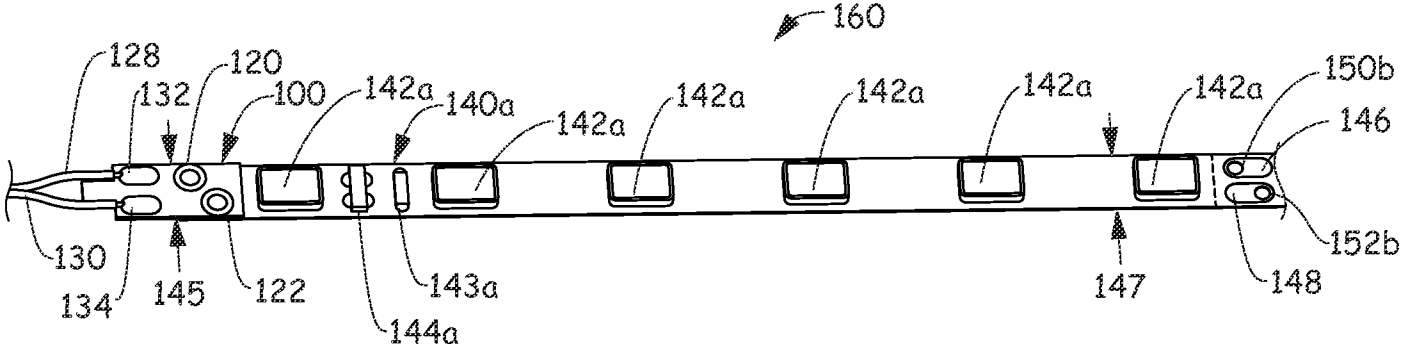
FIG. 5 illustrates a perspective view of an electrical assembly using the board-to-wire connector of FIGS. 1 and 2 to electrically connect one of the LED circuit boards illustrated in FIG. 4 with a power source.
Figure 6:
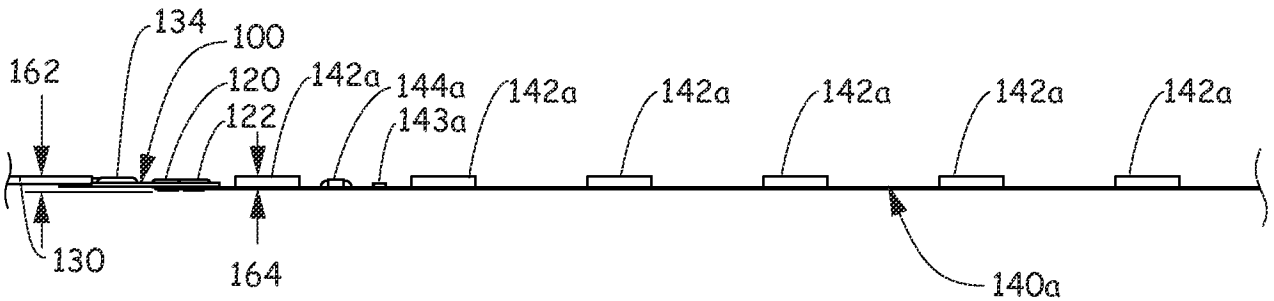
FIG. 6 illustrates a side view of the electrical assembly illustrated in FIG. 5.

FIG. 5 illustrates a perspective view of an electrical assembly 160 including LED PCB 140*a* and board-to-wire connector 100 and FIG. 6 illustrates a side view of FIG. 5. In FIGS. 5 and 6, board-to-wire connector 100 electrically connects LED PCB 140*a* to a power source in the field without using solder. In particular, rivets 120 and 122 are located within or inserted into vias 150*a* and 152*a*. After insertion, a simple mechanical tool is used to crimp rivets 120 and 122 so that the material of prongs 124 and 126 are deformed into vias 150*a* and 152*a* to form a permanent mechanical connection with LED PCB 140*a* without the use of solder. As illustrated, a thickness 162 of board-to-wire connector 100 including wires 128 and 130 when mechanically coupled to LED PCB 140 is less than or substantially equal to a thickness 164 of the LED discrete components 142*a-d* on PCBs 140*a-d*. In addition, a width 145 is less than or substantially equal to a width 147 of LED PCBs 140*a-d* (see FIG. 5). As shown, thickness 162 illustrates the thickness or height of board-to-wire connector 100 and thickness 164 illustrates the thickness or height of the LED discrete components. As such, the LEDs, such as LEDs 142*a*, will be able to be located adjacent to a light panel without the need for the light panel to be notched out to accommodate for the connector that connects the LED PCB 140*a* to a power source.

Also disclosed herein is a method of connecting LED circuit board 140*a-d* to a power source (not shown in the figures). The method includes inserting prongs 124 and 126 on a pair of electrically conductive rivets 120 and 122 that extend through board-to-wire connector 100 and a pair of electrically conducting traces 108 and 110 so they protrude from surface 106 of board-to-wire connector 100 through vias 150*a* and 152*a* in LED circuit board 140*a*. Board-to-wire connector 100 includes a thickness 162 that is less than or equal to a thickness 164 of discrete components on the at least one LED circuit board. The method also includes crimping prongs 124 and 126 to electrically connect electrical conducting traces 146 on the at least LED circuit board to a pair of wires 128 and 130 that electrically connect to a power source through electrical conducting traces 108 and 110 on the board-to-wire connector 100. Strain is reduced on solder joints that are preassembled on board-to-wire connector 100 and that electrically connect the pair of wires 128 and 130 to the board-to-wire connector 100 by placing proximal section 118 of board-to-wire connector that does not have electrical conductive traces between the pair of wires 128 and 130.

Although elements have been shown or described as separate embodiments above, portions of each embodiment may be combined with all or part of other embodiments described above.

Although the present invention has been described with reference to preferred embodiments, workers skilled in the art will recognize that changes may be made in form and detail without departing from the spirit and scope of the invention.

What is claimed is:

1. A board-to-wire connector comprising:

a substrate having a first surface, an opposing second surface, a thickness defined between the first and second surfaces, a distal section and a proximal section, wherein the distal section includes at least two electrically conducting traces having respective conductive pads and wherein the proximal section extends from the distal section and has a width that is less than a width of the distal section;

a pair of wires having ends that are each electrically preassembled to one of the electrically conducting traces in the distal section through the respective conductive pads with solder joints, the solder joints being located on the first surface of the substrate; and a pair of electrically conducting rivets each extending through the distal section of the substrate from the first surface to the second surface and through one of the electrically conducting traces and having prongs that protrude from the second surface of the substrate; and wherein the width of the proximal section is positioned between the pair of wires to reduce strain on the solder joints that connect the ends of the pair wires to the distal section to prevent delamination of the board.

2. The board-to-wire connector of claim 1, wherein the pair of wires are electrically connected to one of the electrically conducting traces through the respective conductive pads at distal ends of the pair of wires and proximal ends of the pair of wires are configured to electrically connect to a power source.

3. The board-to-wire connector of claim 1, wherein the prongs of the pair of electrically conducting rivets that protrude from the second surface of the substrate are configured to be inserted through a pair of holes on a printed circuit board and crimped to provide an electrical and mechanical connection between the pair of wires and the printed circuit board.

4. The board-to-wire connector of claim 3, wherein the substrate and the rivets after having been crimped comprise a thickness that is less than a thickness of the pair of wires.

5. The board-to-wire connector of claim 1, wherein the proximal section of the substrate has a width that is less than a width of the distal section.

6. An electrical assembly comprising:

at least one circuit board including a first surface and an opposing second surface and having an array of one or more electrical components, the at least one circuit board including at least two conducting traces and a pair of holes that each extend through one of the two conducting traces and through the at least one circuit board from the first surface to the opposing second surface;

a board-to-wire connector comprising:

a connector board having a thickness that is less than a thickness of the one or more discrete components on the at least one circuit board and at least two electrically conducting traces having respective conductive pads;

a pair of power wires each electrically connected at distal ends to one of the electrically conducting traces of the connector board through the respective conductive pad with solder joints; and a pair of electrically conductive rivets each extending through the connector board and through one of the electrically conducting traces in the connector board and having prongs that protrude from a surface of the connector board;

wherein the prongs on the pair of rivets are located through the pair of holes on the at least one circuit board and the prongs are crimped against the second surface of the at least one circuit board to form a permanent electrical and mechanical connection with the at least one circuit board.

7. The electrical assembly of claim 6, wherein the connector board comprises a component section and a stress relief section, the component section housing the at least two electrically conducting traces, respective conductive pads and the pair of rivets and the stress relief section extending from the component section and being entirely free of electrical components.

8. The electrical assembly of claim 7, wherein the stress relief section is positioned between the pair of wires to reduce strain on the solder joints to prevent delamination of the board.

9. The electrical assembly of claim 8, wherein the stress relief section comprises a width that is less than a width of the component section.

10. The electrical assembly of claim 6, wherein the array of one or more electrical components comprises at least one LED.

11. The electrical assembly of claim 6, wherein the at least one circuit board comprises a flexible circuit board.

12. The electrical assembly of claim 6, wherein the pair of power wires further comprises proximal ends that are configured to electrically connect to a power source.

13. The electrical assembly of claim 6, wherein a width of the connector board and the pair of power wires is less than or substantially equal to a width of the at least one circuit board.

14. The electrical assembly of claim 6, wherein the at least one circuit board comprises a plurality of circuit boards formed sequentially together in a strip during manufacture.

15. A method of connecting at least one circuit board to a power source, the method comprising:

providing a board-to-wire connector including a connector board having a pair of electrically conducting traces, a pair of electrically conductive rivets that extend through the pair of electrically conducting traces in the connector board and having prongs that protrude from a surface of the connector board and a pair of electrical wires connected to the pair of traces in the connector board by soldering distal ends of the wires to conductive pads on the connector board;

inserting the prongs of the pair of electrically conductive rivets through holes extending through at least one circuit board and in a direction from a first surface to an opposing second surface of the at least one circuit board, wherein the board-to-wire connector includes a thickness that is less than thicknesses of discrete components on the at least one circuit board; and crimping the prongs to the second surface of the at least one circuit board to electrically connect electrical conducting traces on the at least one circuit board to a pair of wires that electrically connect to a power source through electrical conducting traces on the board-to-wire connector.

16. The method of claim 15, further comprising reducing strain on solder joints that electrically connect the pair of wires to the board-to-wire connector by placing a width of a proximal section of the connector board that is free of electrical components between the pair of wires.

17. The method of claim 16, wherein the proximal section extends from a distal section of the connector board that provides the pair of conductive rivets and the conductive pads.

18. The method of claim 15, wherein the discrete component on the at least one circuit board comprises at least one LED.

19. The method of claim 15, wherein the at least one circuit board comprises a flexible circuit board.

20. The method of claim 15, wherein the at least one circuit board comprise a plurality of circuit boards formed sequentially together in a strip during manufacture.

* * * * *